US005779239A

United States Patent [19]

Lind

[11] Patent Number: 5,779,239

[45] Date of Patent: Jul. 14, 1998

[54] CHIP-A-TAK BOARD AND DICE GAME

[76] Inventor: Fenwick E. Lind, 6 Horne Rd., P.O. Box 848, Windham, N.H. 03087

[21] Appl. No.: 812,779

[22] Filed: Mar. 6, 1997

[51] Int. Cl.[6] ..... A63F 3/00

[52] U.S. Cl. ..... 273/260; 273/243; 273/248

[58] Field of Search ..... 273/260, 261, 273/243, 248, 255

[56] References Cited

U.S. PATENT DOCUMENTS

| | | | |
|---|---|---|---|
| 2,273,009 | 2/1942 | Fisher | 273/261 |
| 3,642,286 | 2/1972 | Moore | 273/260 |
| 3,806,125 | 4/1974 | Bialek | 273/260 |
| 4,486,021 | 12/1984 | Karas | 273/255 |
| 4,902,021 | 2/1990 | Burroughs | 273/260 |
| 4,940,240 | 7/1990 | Braley | 273/260 |
| 4,984,806 | 1/1991 | Alfred | 273/255 |
| 5,018,744 | 5/1991 | Patracuolica | 273/260 |
| 5,318,305 | 6/1994 | LoCoco | 273/258 |
| 5,346,224 | 9/1994 | Remus | 273/260 |
| 5,570,887 | 11/1996 | Christie | 273/261 |

*Primary Examiner*—William M. Pierce

*Attorney, Agent, or Firm*—Robert Platt Bell & Associates, P.C.

[57] ABSTRACT

A checkers type board game is provided where movement of playing pieces is determined by the role of the dice. The board is similar to a checkers board, but with 10 longitudinal rows and eight latitudinal rows, for a total of eighty squares. Each player initially places twelve pieces on the board, eight pieces occupying a back row and four pieces centered in the second row. When a player rolls the dice, he or she may move a playing piece diagonally in any direction equal to the number indicated by one or both of the dice. When a player's piece lands on an opposing player's piece, that piece is captured by the player. Once a player's piece has reached the far opposing row, it may not be moved or attacked. Play ends when a player has advanced eight pieces, or remaining pieces, to the opposing row from their starting position. The winner is determined by which player has captured the largest number of pieces.

15 Claims, 6 Drawing Sheets

Figure 6A
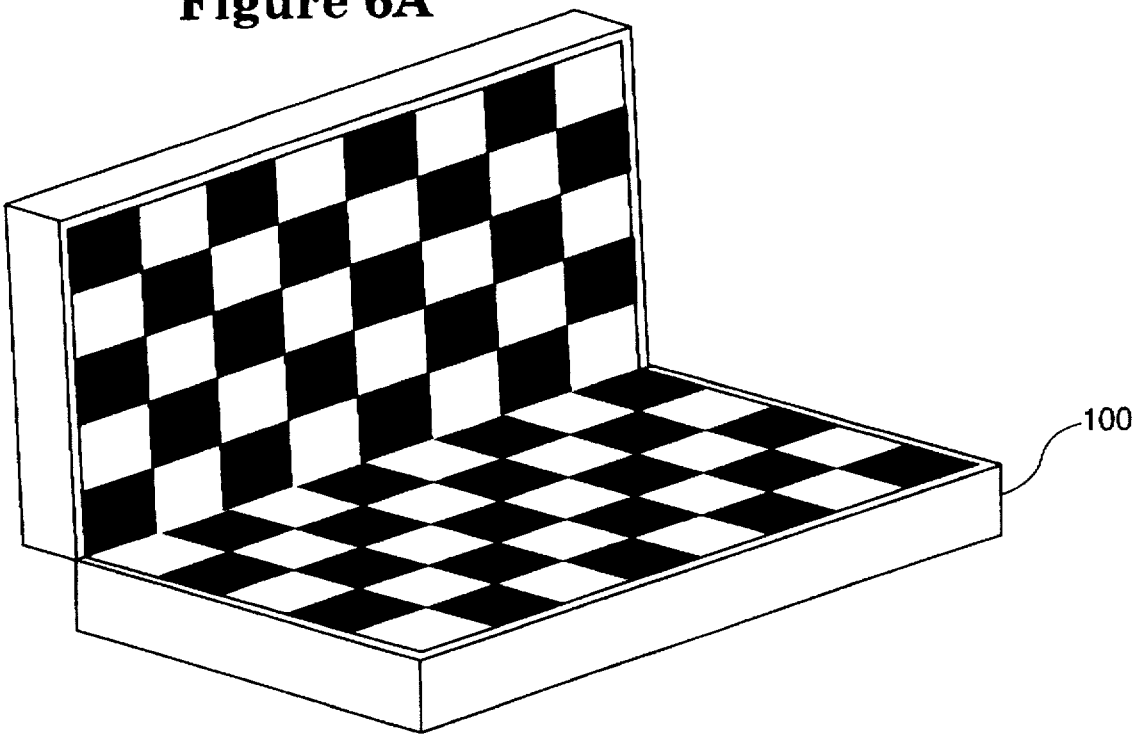
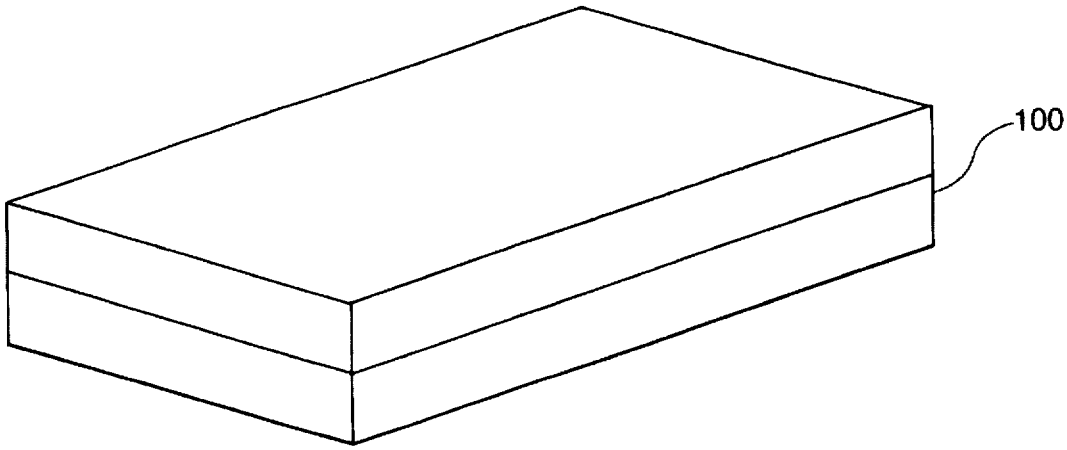
Figure 6B

CHIP-A-TAK BOARD AND DICE GAME

FIELD OF THE INVENTION

The present invention relates to a checkers-type board game, and more particularly relates to such a board game where an additional element of chance is added.

BACKGROUND OF THE INVENTION

Conventional checkers are played on a board having a lined vertical and horizontal rows of regular spaces, which form diagonal playing spaces. A plurality of checkers playing pieces are placed are the playing spaces, on opposite sides of the board, three rows deep. The game progresses through alternative movement of the players' checkers playing pieces. The jumping of an opponents' playing piece resulting in a loss of that piece to the opponent. The game is won by one player removing all the other player's playing pieces from the board.

Although checkers has enjoyed a long, rich tradition in this country, it has lately faded from popularity. It is viewed by many as being too simple a game or a past time for the elderly. Other grid board games such as chess are viewed as too time consuming and complicated and may intimidate the average player because of the endless combinations of moves and strategies.

Variations on the game of checkers are known. U.S. Pat. No. 4,902,021, issued Feb. 20, 1990, to Burroughs teaches a checker and dice board game in which numbered checker playing pieces correspond with numbers on a pair of thrown dice. The dice, when thrown, will determine which checkers qualify to be moved.

Remus, U.S. Pat. No. 5,346,224, issued Sep. 13, 1994, discloses a penalty checkers game. A checkers board is provided with all spaces of one color being numbered consecutively. Each player, upon completing a move on the board must make a move as well with respect to card and card receiving spaces on a second board. While the game does provide more chance and an interesting variation from standard checkers, the rules are fairly complex and require specialized gaming pieces.

SUMMARY OF THE INVENTION

It is an object of the present invention to provide a novel type of board game introducing an element of chance whereby a player rolls a pair of dice to determine how many spaces he may move a particular playing piece.

In accordance with the present invention, in addition to a checkers-like board, a number of different colored chips (e.g., poker chips) are provided for each player as playing pieces. Each player may purchase these playing pieces from the "bank" if the game is to be paid for wagers.

A total of twelve pieces are placed on the board, eight in the back row and four centered in the front row. Each player alternates turns, rolling a pair of standard six-sided dice. The numbers turning up on the dice determine the number of spaces a player may move his pieces. All pieces are moved diagonally across the board.

A player may choose to move one piece the total number of spaces indicated by the dice, or may move two pieces, each according to the number turned up on an individual die. If a player's piece lands on his opponent's piece, that piece is captured.

The game ends when a player fills the entire opposite edge row of the playing board or no further moves of advantage may be made by either player at his turn.

The game may also be adapted for computer use to allow two players to play electronically or to allow a player to play against the computer. Moreover, the game may be adopted to be played electronically through a network (e.g., Internet or the like) between two remote players.

BRIEF DESCRIPTION OF THE DRAWINGS

These and other objects and advantages of the present invention will become apparent upon reading the following detailed description and upon referring to the drawings in which:

FIG. 6A is an orthogonal view of the playing board of FIG. 5 is a semi-folded state.

FIG. 6B is an orthogonal view of the playing board of FIG. 6A in a folded state.

Figure 1:
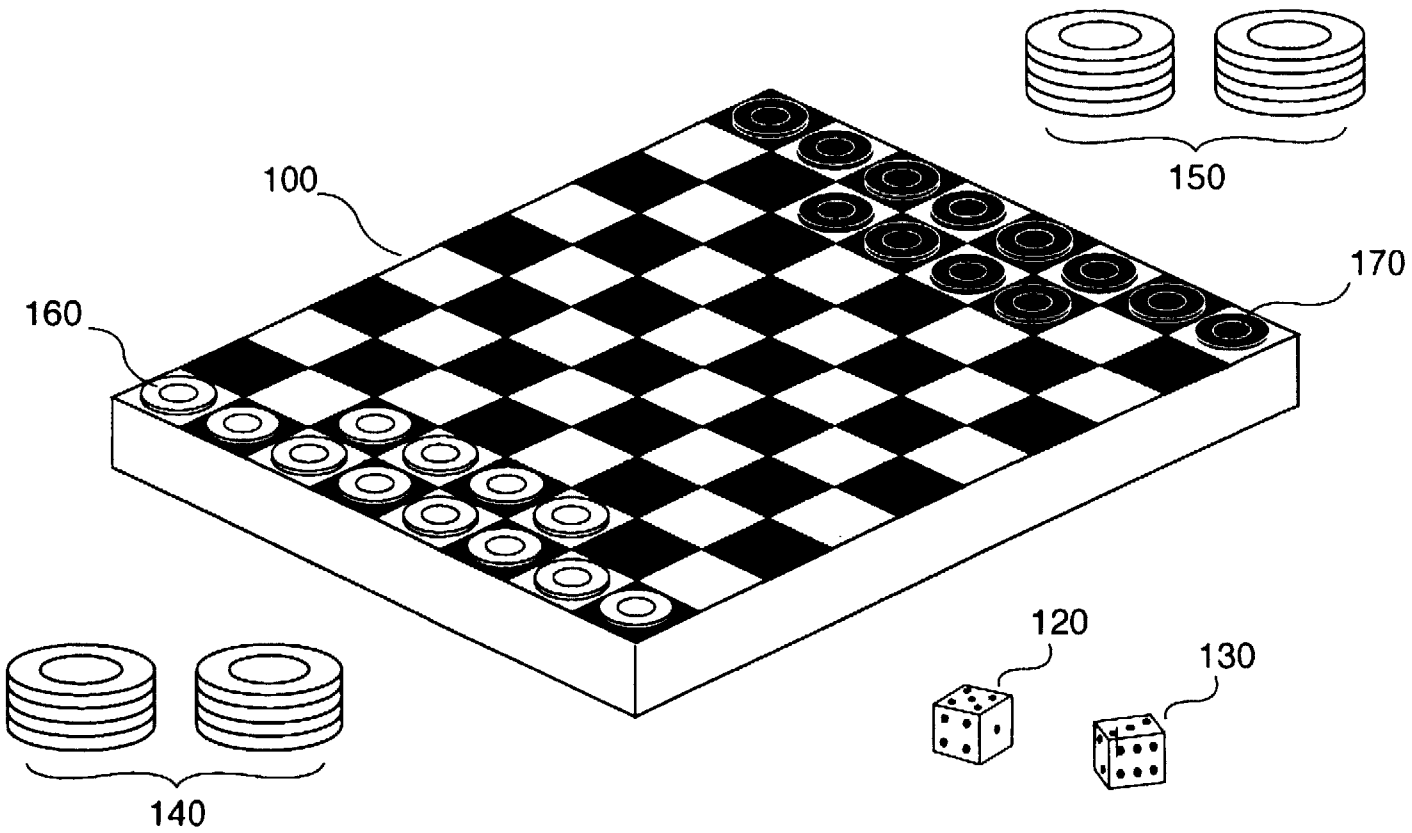
FIG. 1 is an orthogonal view of the components of the board game of the present invention.

While the invention will be described in conjunction with the illustrated embodiments, it will be understood that it is not intended to limit the invention to such embodiments. On the contrary, it is intended to cover all alternatives, modifications, and equivalence as may be included within the spirit and scope of the invention as defined by the appended claims.

DETAILED DESCRIPTION OF THE PREFERRED EMBODIMENTS

In the drawings, similar features have been given similar reference numerals.

FIG. 1 is an orthogonal view of the components of the board game in accordance with the present invention. FIG. 1 illustrates these components laid out with play ready to commence. The board game of the present invention may be sold under the trademark Chip-A-Tak™.

Referring to FIG. 1, board 100 may comprise a checkers-type board having a grid of eight squares by ten squares (total of eighty squares) having alternating colors. In the preferred embodiment, an eight-by ten checkers-type board may be used, however other size boards may be used to increase or decrease the complexity and skill of the game. For example, a smaller size board (e.g., a standard checkers board of eight squares by eight squares) may result in a shorter and less challenging game. A larger board (e.g., ten squares by ten squares) may result in prolonged play and higher stakes. A larger or smaller number of playing pieces may be accordingly assigned to different size boards. Moreover, additional players may be added (e.g., four player Chip-A-Tak™) without departing from the spirit and scope of the present invention.

Each player is assigned (or buys) a number of playing pieces or "chips." These chips may comprise conventional checkers pieces, or, in the preferred embodiment, standard poker-type chips. In the preferred embodiment, each player is assigned (or buys) twenty chips from a "bank."

Each player receives chips of a different color from the other player. For a first player, twelve of these white chips 160 are arranged on board 100 as illustrated in FIG. 2, with eight chips filling the back row of the board and four chips filling the center four spaces of the second row in the preferred embodiment.

Figure 2:
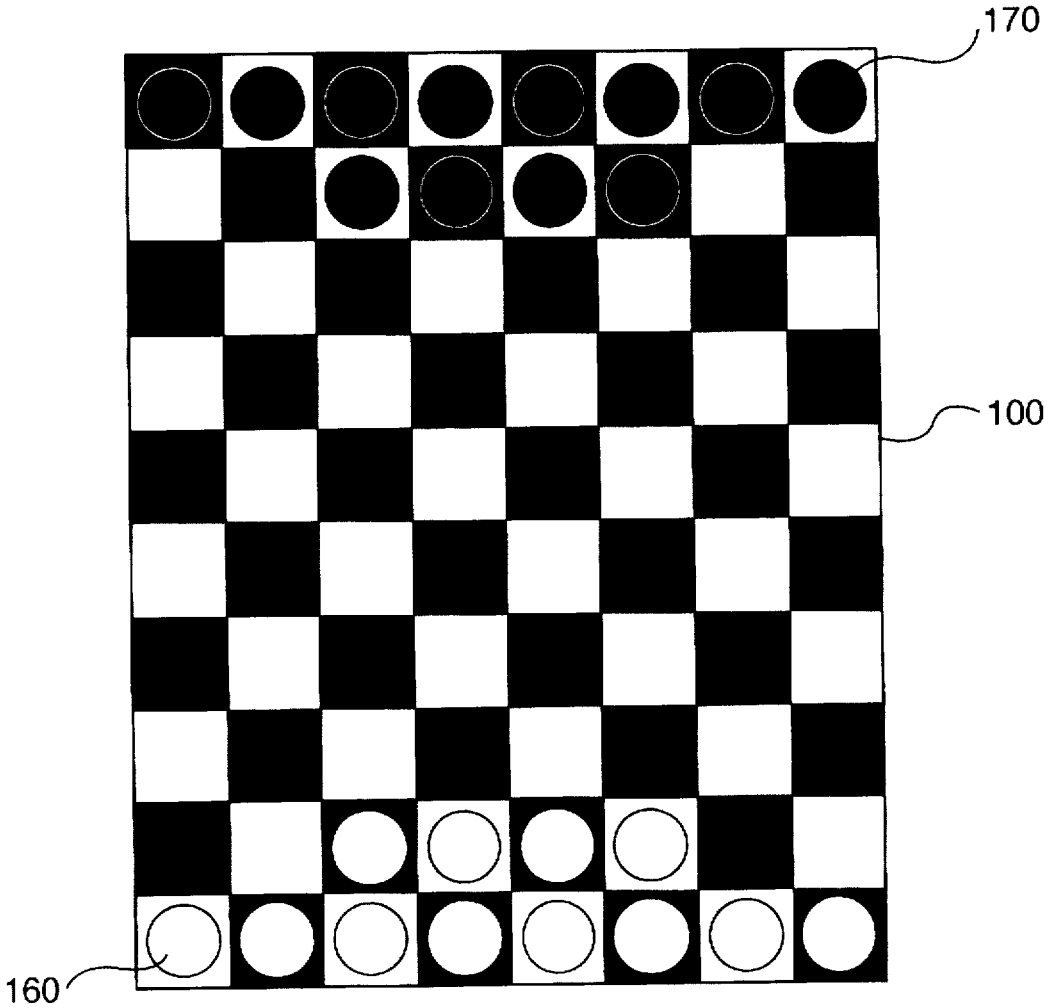
FIG. 2 is a plan view of the board game of the present invention illustrating the location of the playing pieces upon commencement of the game.

The second player may arrange twelve black chips 170 in the same pattern as the first player, however on the opposite side of the board as illustrated in FIG. 2. For purposes of illustration only, chips 160,140 are illustrated as white, and chips 170,150 are illustrated as black. In the preferred embodiment, other colors may be used (e.g., blue and yellow).

Again, the number of chips purchased, as set forth above, is for the preferred embodiment of the present invention and is no way intended to limit the scope of the present invention. A greater or lesser number of chips may be purchased as determined by the rules of the game without departing from the spirit or scope of the present invention.

Dice 120, 130 may be standard six-sided dice as are known in the art. Each side of each dice 120, 130 may be numbered with a number of dots from one to six. Other numbered sided dice may be used with the present invention without departing from the spirit or scope of the present invention. In addition, although two dice are shown in FIG. 1, other numbers of dice may be used (e.g., one, three, four, and the like) without departing from the spirit or scope of the present invention.

The rules for the game and the procedure for playing the game will be described below in connection with FIGS. 2 through 4.

The object of the game is for a player to attempt to move his or her chips across the board to the opposite edge row, capturing as many opponent chips as possible in route per total roll of two dice. Players alternate turns rolling the dice. Rolling a double entitles the player to roll again if he or she so chooses. Otherwise, the dice are passed to the opponent for play.

Each player purchases up to twenty chips of one color from the "bank", which may be mutually supervised by both players. Each player uses chips of a different color from the opposing player.

Players may purchase chips from the "bank" using real money and thus the game may be used for gambling purposes in states, municipalities, and territories where gambling is legal. Otherwise, play money or script may be used to "purchase" chips from the "bank."

Each player sets up twelve of their playing pieces 160, 170 as illustrated in FIG. 2.

Each player rolls one die to determine who will go first. Whichever player rolls the highest value goes first. If both players roll the same value, then both players will roll again until one rolls a higher value. Thereafter, all rolls are with two dice.

Figure 3:
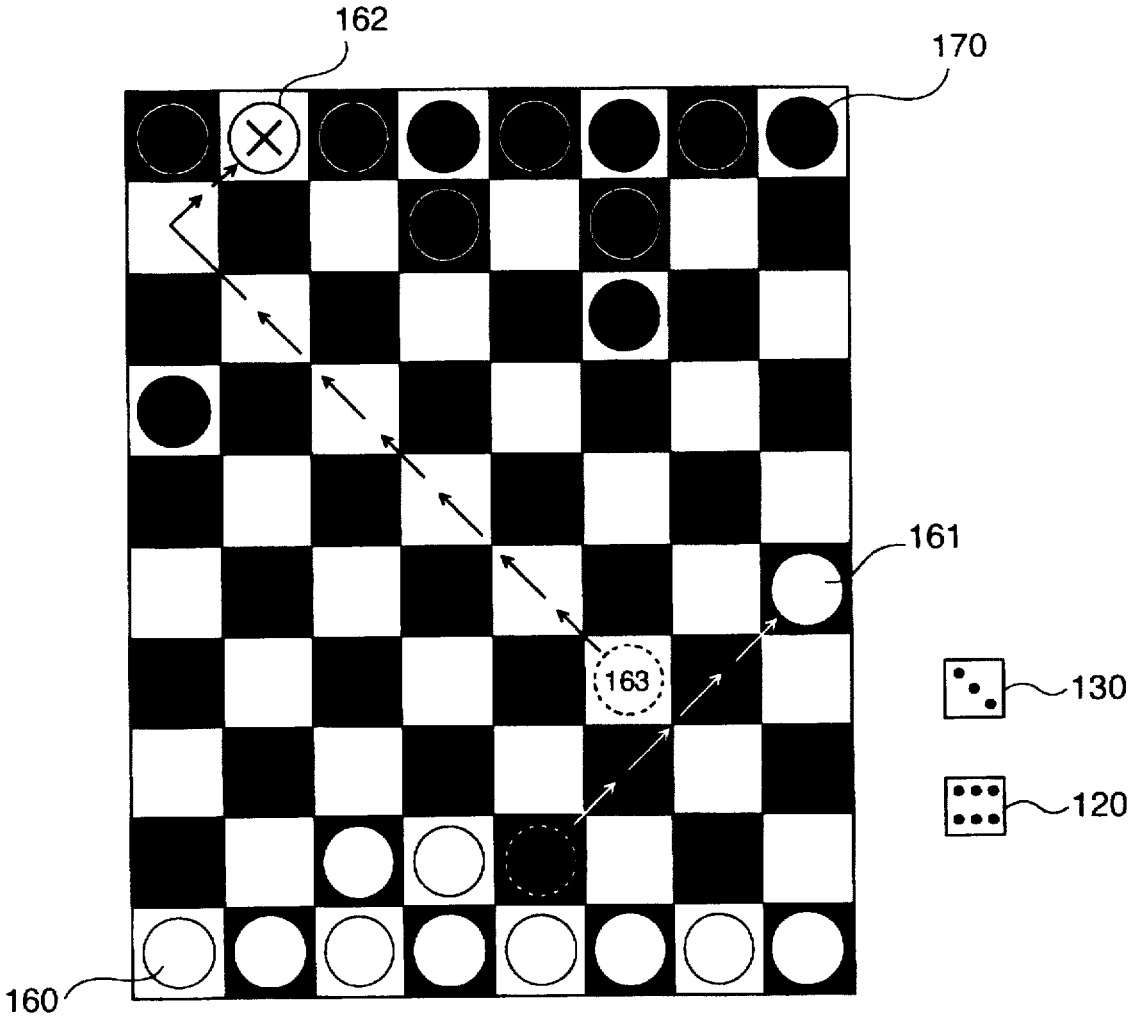
FIG. 3 is a plan view of the board game of the present invention illustrating an example of a player move in response to a roll of the dice.

FIG. 3 illustrates an example of a move by a player. In the drawings as shown, two different colored playing pieces are illustrated, black and white. These colors are shown only for purposes of illustration. Other differing colors (e.g., red and yellow, red and black, red and white, and the like) may be used so long as the chips of each color are distinguishable from one another.

In FIG. 3, white player has previously moved one playing piece 162 to a position 163 during a previous turn. White player, during this turn, has rolled a nine, one dice with a six, and the other with a three. White player has a number of choices in this regard. White player may move one piece a total of nine spaces, or may move one piece a total of three spaces, and another piece a total of six spaces. All moves must be made diagonally in any direction on squares of original color placement. Thus, a piece originally placed on a light square remains on light squares and a piece originally placed on a dark square remains on dark squares.

The total value of the dice must be used to complete a player's move. When a player's chip lands on an opponent's chip, it captures that chip and, player's own chip is placed on top of it. Further moves and captures by the player's chip carries along all chips that are underneath. No chips are removed from the board as in checkers or other board games.

In an example of FIG. 3, white player has elected to move playing piece 161 three spaces diagonally forward. White player has also elected to move playing piece 162 five spaces diagonally forward to the left and one space toward the right. Player may change direction of his or her chip any time during the move so long as the move is made diagonally. Moreover, no chip is permitted to cross its own path or initial starting square during a turn. In this instance, white player has elected to move playing piece 162 five spaces diagonally toward the left and one space to the right landing on black player's back row chip, capturing that chip underneath.

Once an attacking player reaches the opponent's rear row (far edge), that playing piece may not be moved again, or attacked. Additionally, a bonus chip must be paid to the attacker, but only if requested by saying "pay me" to his opponent. If not requested by the next roll of the dice, the bonus is forfeited. If the bonus is requested, black player then places an additional chip underneath white player's chip 162. Black player obtains this bonus chip from his or her stack 150 (FIG. 1).

Jumping over any chip is not permitted, including a player's own chips. A player's move is completed when a player lifts his or her hand from the chip being moved.

In addition, the first row of four attacking chips (centrally placed) must be moved out first before any of the rear eight edge chips are allowed to be moved. A captured first row chip is considered "moved out."

Figure 4:
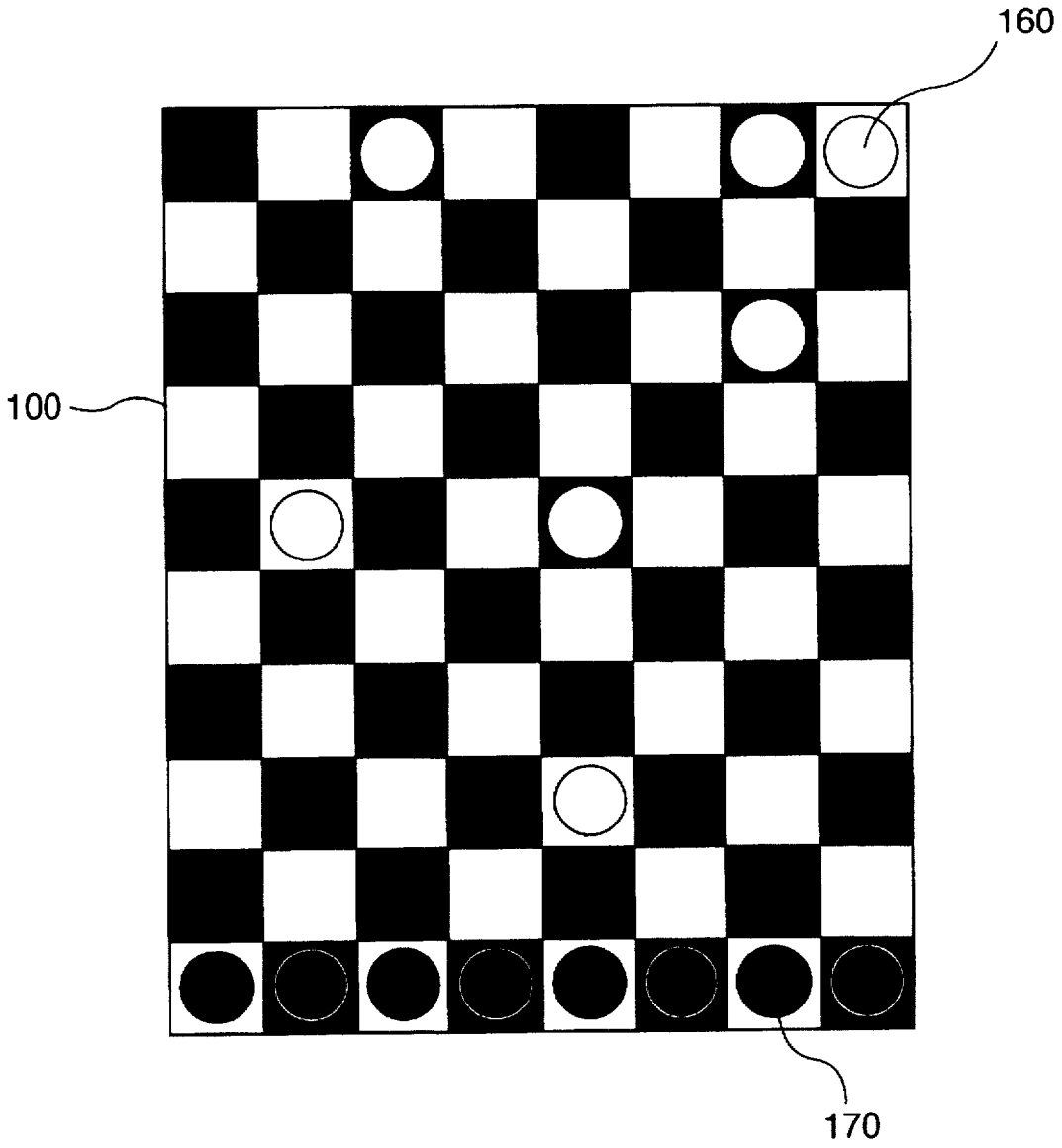
FIG. 4 is a plan view of the board game of the present invention illustrating a condition when the game is over.

FIG. 4 illustrates a scenario in the present invention where black player has won the game by filling the entire opposite edge row with eight black chips. The game may also be ended if no further move of advantage may be made by either player at his or her turn. Once the game has ended, each player may redeem the chips of his own color along with any captured chip from the "bank" at whatever value each chip was worth at the time of purchase.

Thus, the "winner" of the game is determined by which player captures the most chips. The player ending the game by filling the opposite end of the board may or may not necessarily be the "winning" player, depending upon how many chips captured by each player.

It will be seen that, although the game of the present invention may initially appear to resemble checkers, a significantly different game results, providing a fast pace, additional elements of chance, and the opportunity to gamble.

In addition to the board game discussed above, Chip-A-Tak™ may be readily adopted to electronic formats as well. As can be appreciated by one of ordinary skill in the art, a simple computer program can be written to keep track of the location of each chip, serve as a bank, and provide a random-numbered generator to simulate the function of dice.

Using such a program, two players may play against each other or play through a network such as the Internet or the like.

In addition, such a computer can be programmed to play a human opponent. With each roll of the dice, the computer may calculate all possible moves of chips of its color and determine which moves produce the optimum result (capturing the most number of pieces, filling the back row, and the like). Such a computerized version may be useful in gaming situations where such electronic gambling devices are legal.

Figure 5:
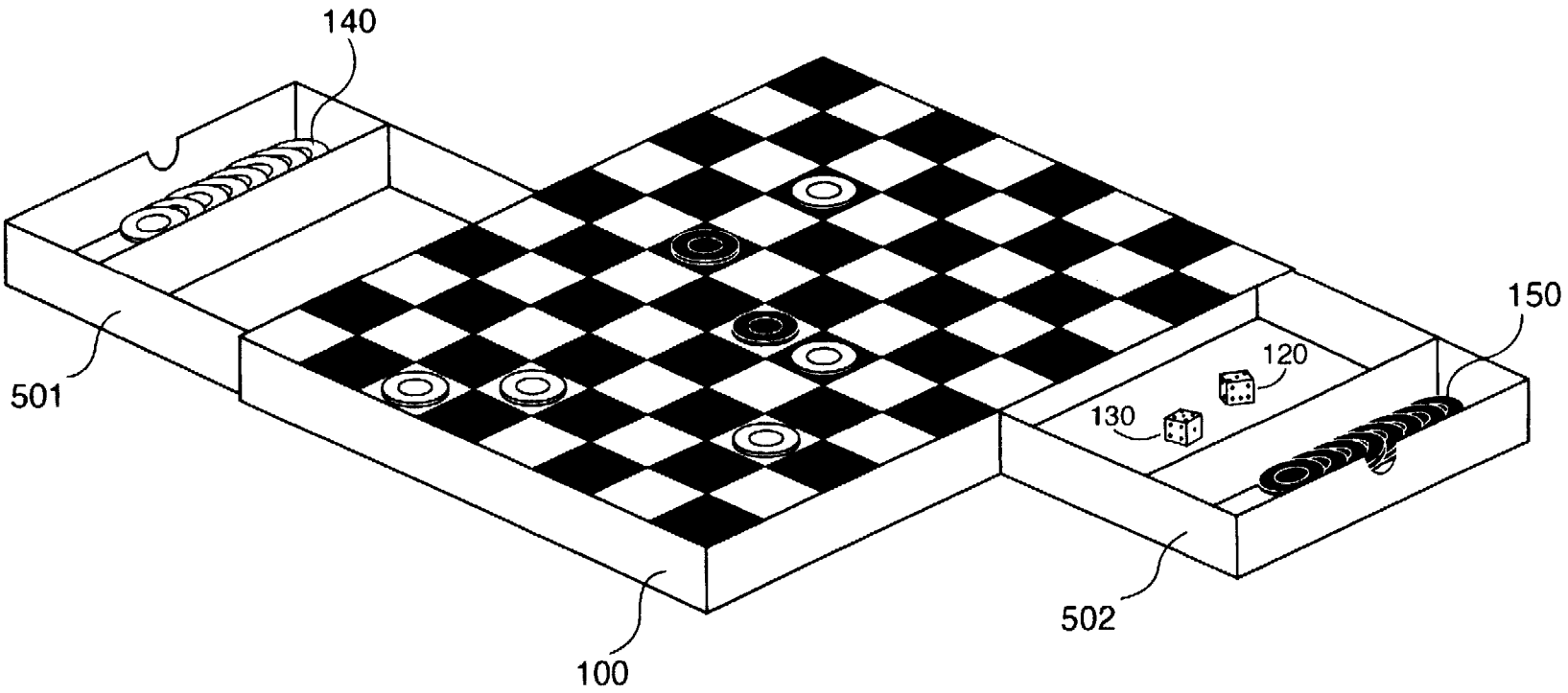
FIG. 5 is an orthogonal view of the components of the board game of the present invention, provided in a self-storing carrying case.

FIG. 5 illustrates a preferred embodiment of the present invention, providing a carrying case for Chip-A-Tak™. The carrying case may be inexpensively made from folded cardboard or the like (as in applicant's prototype) or may be assembled from more durable materials (wood, plastic, metal, or the like). As illustrated in FIG. 5, drawers 501, 502 may be provided for holding chips 140, 150 and dice 120,130. In addition, play money, scrip, rules and instructions, and the like may be stored in drawers 140,150.

FIG. 6A illustrates how board 100 may be folded once drawers 501,502 are closed. FIG. 6B illustrated the closed board 100, which forms a compact and attractive carrying case. Board 100 may close upon itself and be secured by a fastening means (latch or the like) which in the prototype embodiment comprises a Velcro™ dot.

Thus, it is apparent that there has been provided in accordance with the invention, a board game that fully satisfies the objects, aims, and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the invention.

What is claimed is:

1. In a board game comprising a board having aligned vertical and horizontal rows including diagonal rows of playing spaces of alternating colors, a plurality of playing pieces of two different colors, each color provided for a corresponding player, and a means for generating at least one random number, a method of play comprising the steps of:

each corresponding player taking an alternate turn, each turn comprising the steps of:

generating a random number with the means for generating at least one random number, moving at least one of the plurality of playing pieces of a color corresponding to the corresponding player a number of spaces equal to or less than the random number, wherein the total spaces moved by all of the at least one of the plurality of playing pieces during a turn is equal to the random number.

2. The method of claim 1 wherein the board has ten longitudinal and eight latitudinal rows forming a total of eighty alternately colored playing spaces.

3. The method of claim 2 wherein the at least one random number generating means comprises a pair of dice.

4. The method of claim 3 wherein the pair of dice comprise two six-sided dice.

5. The method of claim 4 wherein a playing piece may be moved a number of spaces as indicated by one of said pair of dice or by the total of both of said pair of dice.

6. The method of claim 5 wherein each playing piece may only be moved diagonally.

7. The method of claim 6 wherein an opponent piece is captured when landed on by a playing piece.

8. The method of claim 7, wherein during a turn, a player may not jump any piece on the board.

9. The method of claim 8, wherein each playing piece may be moved in any diagonal directions such that the playing piece does not cross its own path or starting square during a turn.

10. The method of claim 9 wherein a playing piece may not be further moved or attacked once it reaches a far edge row of the board.

11. The method of claim 10, wherein a player may request a bonus chip from an opponent when a playing piece moves across the board.

12. The method of claim 11, wherein the game ends when no further move of advantage may be made by either play at his or her turn.

13. The method of claim 9, wherein each player is initially provided with a total of twelve playing pieces and each player's playing pieces on arranged on opposite side of the board.

14. The method of claim 9, wherein each player's twelve playing pieces are arranged on the board such that eight of the twelve playing pieces are arranged on a back latitudinal row of the board, and four of the player's twelve playing pieces are arranged centered on a row second from the back latitudinal row.

15. The method of claim 9 wherein the game is ended when a player has filled all eight spaces on an opposite side of the board from the player's starting location with playing pieces.

* * * * *